US007936208B2

(12) United States Patent
Clements et al.

(10) Patent No.: US 7,936,208 B2
(45) Date of Patent: May 3, 2011

(54) BIAS CIRCUIT FOR A MOS DEVICE

(75) Inventors: Steven Mark Clements, Raleigh, NC (US); Hayden C. Cranford, Jr., Cary, NC (US); Amar Chandra Mahadeo Dwarka, Raleigh, NC (US); John Farley Ewen, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/184,148

(22) Filed: Jul. 31, 2008

(65) Prior Publication Data

US 2010/0026376 A1 Feb. 4, 2010

(51) Int. Cl.
*G05F 3/02* (2006.01)

(52) U.S. Cl. ..... 327/543

(58) Field of Classification Search ..... None
See application file for complete search history.

(56) References Cited

U.S. PATENT DOCUMENTS

| | | | | |
|---|---|---|---|---|
| 5,034,626 | A * | 7/1991 | Pirez et al. | 327/542 |
| 5,109,187 | A * | 4/1992 | Guliani | 365/185.21 |
| 5,394,026 | A | 2/1995 | Yu et al. | |
| 5,675,280 | A * | 10/1997 | Nomura et al. | 327/538 |
| 5,777,509 | A * | 7/1998 | Gasparik | 327/542 |
| 5,903,012 | A | 5/1999 | Boerstler | |
| 7,106,129 | B2 | 9/2006 | Nakai | |
| 7,327,126 | B2 * | 2/2008 | Yoshihara | 323/271 |
| 2003/0227322 | A1 * | 12/2003 | Ozoe | 327/541 |
| 2006/0226889 | A1 | 10/2006 | Gupta et al. | |
| 2007/0030049 | A1 * | 2/2007 | Yoshikawa | 327/512 |

OTHER PUBLICATIONS

Koichiro Ishibashi, 'Adaptive Body Bias Techniques for Low Power SOC', Renesas Technology Corp., Semiconductor Technology Academic Research Center (STARC); 2007 IEEE International Solid-State Circuits Conference.

Koichiro Ishibashi, 'Adaptive Body Bias Techniques for Low Power SOC', Renesas Technology Corp., Semiconductor Technology Academic Research Center (STARC); 2007 IEEE International Solid-State Circuits Conference.

* cited by examiner

*Primary Examiner* — Lincoln Donovan
*Assistant Examiner* — Khareem E Almo
(74) *Attorney, Agent, or Firm* — Yee & Associates, P.C.; Ian D. MacKinnon

(57) ABSTRACT

A method and circuit for providing a bias voltage to a MOS device is disclosed. The method and circuit comprise utilizing at least one diode connected circuit to provide a voltage that tracks process, voltage and temperature variations of a semiconductor device. The method and circuit includes utilizing a current mirror circuit coupled to the at least one diode connected circuit to generate a bias voltage for the body of the semiconductor device from the voltage. The bias voltage allows for compensation for the process, voltage and temperature variations.

1 Claim, 2 Drawing Sheets

BIAS CIRCUIT FOR A MOS DEVICE

FIELD OF THE INVENTION

The present invention relates generally to a semiconductor circuits and more particularly to bias circuits for low voltage applications.

BACKGROUND OF THE INVENTION

MOS circuits, particularly CMOS circuits, are utilized in a variety of applications. For example, these circuits are utilized in level shifters, oscillators, phase rotators, inverters, and the like. It is known that running these circuits at low supply voltages affect the performance of the circuits over process, temperatures and supply voltage variations.

The power dissipation of CMOS circuits is roughly proportional to the square of the supply voltage, and so running these circuits at low supply voltages is important to achieve low power dissipation. However, the performance of many CMOS circuits degrades rapidly as the supply voltage approaches the sum of the threshold voltages of the NMOS and PMOS devices. The threshold voltage of the MOS devices is also a strong function of temperature. Organizing circuit performance for the low-voltage, low-temperature (high-Vt) corner typically results in excessive power dissipation at the high voltage, high-temperature (low-Vt) corner.

There are many techniques that compensate for process, temperature and supply voltage variations. Some of these techniques are diverted to providing a bias voltage to the MOS device(s) to compensate for the above mentioned variations. However, known techniques typically include a feedback loop to control the bias voltage. Other techniques directly compensate for these variations. These known conventional techniques, however, are oftentimes not effective, particularly in low voltage applications.

Accordingly, what is needed is a system and method for compensating for process, voltage and temperature variations in a MOS device(s). The system and method should be cost effective, easily implemented and adaptable to existing circuits. The present invention addresses such a need.

SUMMARY OF THE INVENTION

A method and circuit for providing a bias voltage to a MOS device is disclosed. In one embodiment, the method comprises utilizing at least one diode connected circuit to provide a voltage that tracks process, voltage and temperature variations of a semiconductor device. The method also includes utilizing a current mirror circuit coupled to the at least one diode connected circuit to generate a bias voltage for the body of the semiconductor device from the voltage. The bias voltage allows for compensation for the process, voltage and temperature variations.

In a second embodiment, the circuit comprises at least one diode connected circuit configured to provide a voltage that tracks process, voltage and temperature variations of a semiconductor device; and a current mirror circuit coupled to the at least one diode connected circuit configured to generate a bias voltage for the body of the semiconductor device from the voltage. The bias voltage compensates for the process, voltage and temperature variations.

Accordingly, a circuit is provided for controlling the body bias to the MOS devices to effectively adjust the threshold voltage and compensate for variation in process, temperature, and voltage. While this circuit will not eliminate all variation due to process, temperature, and voltage, it can significantly reduce the overall variation and allow for better optimization of circuit performance over corner conditions. This bias circuit can be used in a variety of applications, such as level-shifters, VCOs, phase rotators, etc.

DETAILED DESCRIPTION OF PREFERRED EMBODIMENTS

The present invention relates generally to a semiconductor circuits and more particularly to bias circuits for low voltage applications. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1A:
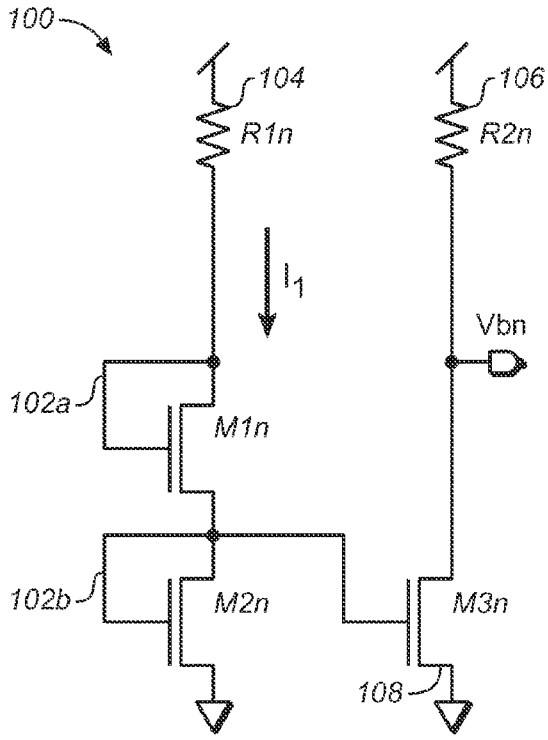
FIG. 1A is a schematic of a first embodiment of a bias circuit which is used to generate a bias voltage for one or more NMOS devices.

To describe the features of this method and system in more detail, refer now to the following description in conjunction with the accompanying Figures. FIG. 1A shows a bias circuit which is used to generate a bias voltage for one or more NMOS devices. Bias circuit 100 includes a resistor 104, coupled to a pair of diode connected transistors 102A and 102B. The transistor 102B is coupled to ground. The diode connected transistor 102A and 102B in turn are coupled to a gate of a current mirror transistor 108. The transistor 108 is coupled to a second resistor 106 and to ground. The other end of the second resistor 108 is coupled to the supply voltage. The circuit 100 can be utilized to provide a bias voltage $V_{bn}$ to the body of one or more NMOS devices (riot shown).

Figure 1B:
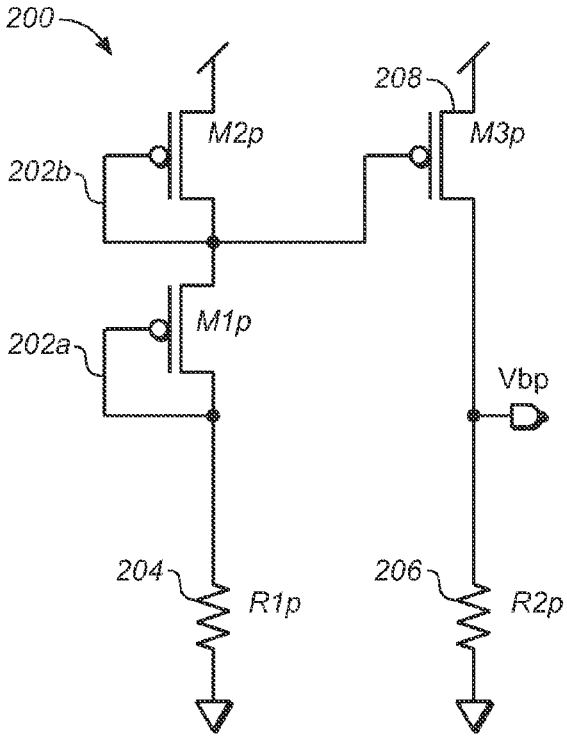
FIG. 1B is a schematic of a complementary bias circuit which can be used to generate a bias voltage for one or more PMOS devices.

FIG. 1B shows a complementary circuit 200 which can be used to generate a bias voltage for one or more PMOS devices. Bias circuit 200 includes a pair of diode-connected transistors 202*a* and 202*b*, coupled to resistor 204, which is coupled to ground. The diode connected transistors 202*b* and 202*a* are coupled to another diode connected transistor 208. Diode connected transistor 208 is coupled to resistor 206, which is then coupled to ground. The circuit 200 can be utilized to provide a bias voltage $V_{bp}$ to one or more PMOS devices (not shown).

Referring back to FIG. 1A, diode-connected transistors 102A and 102B are connected in series with resistor 104. The current in this branch is determined by the equation:

$$I_1 = \frac{V_{dd} - 2 \cdot V_{gs}}{R_{1n}}$$

This current is mirrored by the current mirror transistor 106 (assuming equal W/L for all devices) such that the bias voltage, $V_{bn}$, is determined by the equation:

$$V_{bn} = V_{DD} - R_{2n} \cdot \left(\frac{V_{DD} - 2 \cdot V_{gs}}{R_{1n}}\right) = V_{DD}\left(1 - \frac{R_{2n}}{R_{1n}}\right) + 2\frac{R_{2n}}{R_{1n}} V_{gs}$$

$V_{gs}$ is a function of the device threshold voltage, $V_{th}$, and therefore tracks process and temperature variations. When $V_{th}$ increases, for example at low temperature, the output voltage will also increase. Increasing the bias voltage, $V_{bn}$, when applied to the body of an NMOS device, will act to effectively decrease the threshold voltage of that device and partially compensate the variation due to process or temperature. In fact, the voltage dependence of the bias can be modified by the appropriate ratio of resistor 104/resistor 106. In particular, choosing the value of resistor 106 to be greater than the value of the resistor 104 allows for a negative voltage coefficient which can be used to compensate for supply voltage variations. Again, a complementary circuit 200 shown in FIG. 1B can be used to generate a bias voltage for PMOS transistors.

Circuit simulations have shown that when the circuit is used to bias the body of an MOS device, it will effectively act to compensate for process, temperature and supply variations of the body.

Figure 2:
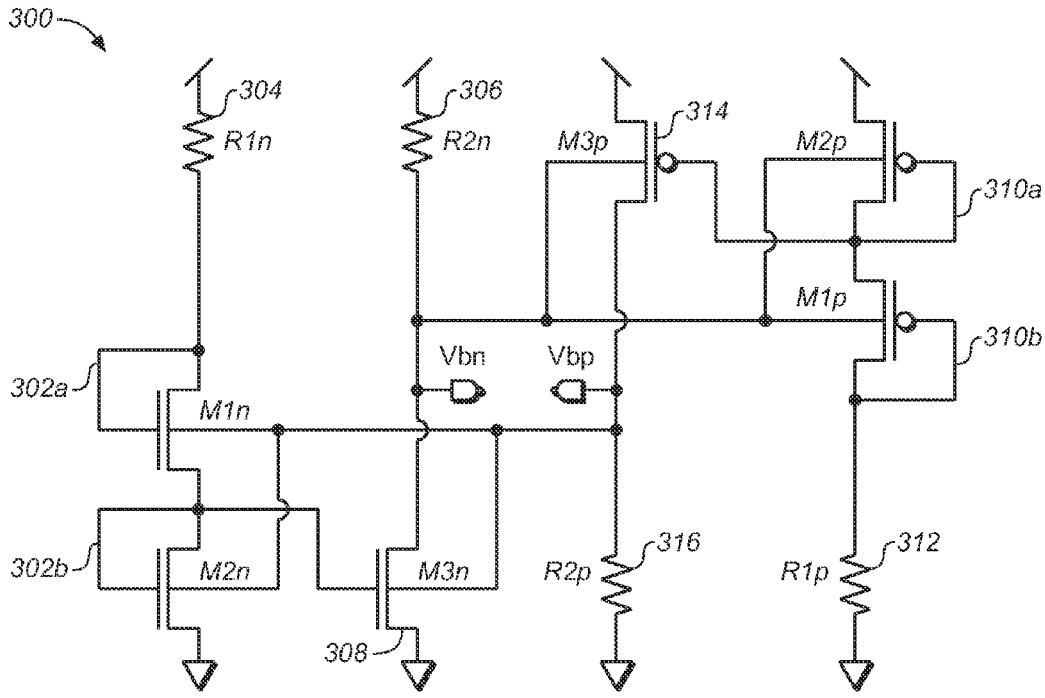
FIG. 2 is a schematic of a second embodiment of a bias circuit in which the generated bias is being used in the circuit itself, to bias the body of both NMOS and PMOS devices.

FIG. 2 is a second embodiment of a bias circuit 300 in which the generated bias is being used in the circuit itself to bias the body of both NMOS and PMOS devices. In this embodiment, resistor 304 is coupled to diode connected transistors 302*a* and 302*b*, which are in turn, coupled to diode connected transistors 308 and resistor 306. Diode connected transistor 308 is coupled to resistor 316, which is coupled to ground. Resistor 306 is coupled to diode connected transistor 314, which is then coupled to transistor 310*a* and 310*b*. Transistors 310*a* and 310*b* are coupled to resistor 312, which is coupled to ground.

In this embodiment, the bias voltage, $V_{bp}$, is applied to the NMOS devices and the bias voltage, $V_{bn}$, is applied to the PMOS devices. Instead of compensating for pressure, voltage and temperature variations, the bias voltage increases the sensitivity to process, voltage and temperature variations and extends the range of the bias outputs, $V_{bp}$ and $V_{bn}$, which may be beneficial in certain applications.

Figure 3:
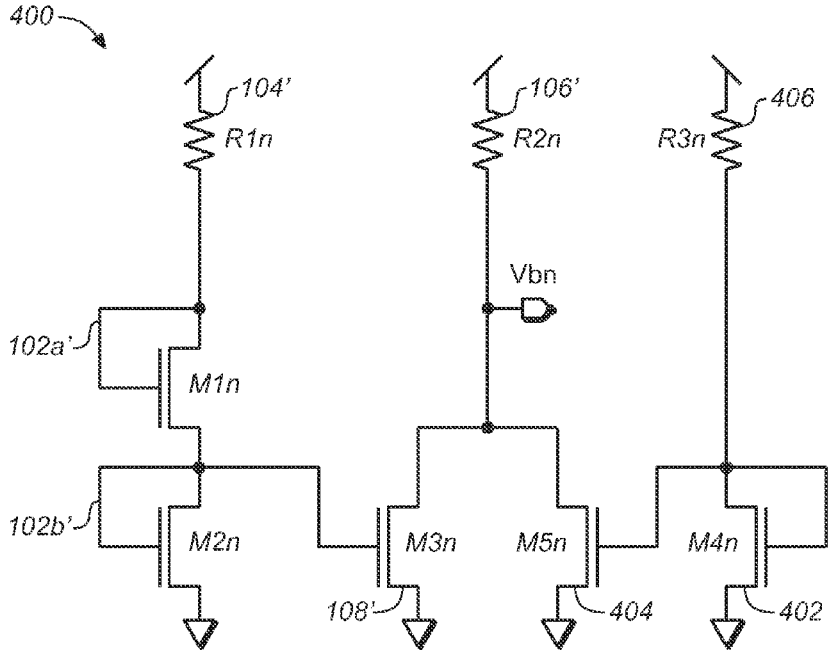
FIG. 3 is a schematic of only the NMOS portion of a third embodiment of a substrate bias circuit.

Finally, bias voltages with an arbitrary sensitivity to process, voltage and temperature variations can be generated by combining the outputs of multiple versions of the basic circuit. One such example is shown in FIG. 3. FIG. 3 is a schematic of only the NMOS portion of a third embodiment of a substrate bias circuit 400. The left half of the circuit replicates that in FIG. 1. The right half is similar but contains a single diode-connected MOS device 402. MOS device 402 is connected to the diode connected transistor 402 which is then connected to resistor 406 and to ground. The MOS diode connected device 402 will have less temperature sensitivity than the stacked diodes 102*a*' and 102*b*'. By adjusting the resistor values 104', 106' and 406 and the relative weights of current mirrors 108' and 404', an arbitrary sensitivity can be optimized between the two extremes. A complementary PMOS version can also be constructed utilizing PMOS devices.

Accordingly, by using a bias circuit in accordance with an embodiment of the present invention, process, voltage and temperature variations can be addressed in a simple and efficient fashion. By utilizing a signal produced by at least one diode connected transistor circuit in conjunction with a current mirror circuit, process, voltage and temperature variations can be constantly tracked. In so doing, a bias circuit is provided that can be utilized in a variety of low voltage applications to maintain consistent performance characteristics thereof.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A CMOS circuit comprising:

a first bias circuit comprising a diode connected circuit configured to provide a first voltage that tracks process, voltage and temperature variations of a first semiconductor device; and a first current mirror circuit coupled to the first diode connected circuit to generate a first output bias voltage that is coupled to the first semiconductor device and biases the body of one or more first semiconductor devices from the first output bias voltage; the first output bias voltage compensating for the process, voltage and temperature variations; and a second bias circuit coupled to the first bias circuit, the second bias circuit comprising a second diode connected circuit configured to provide a second voltage that tracks process, voltage and temperature variations of one or more second semiconductor devices; and a second current mirror circuit coupled to the second diode connected circuit to generate a second output bias voltage that is coupled to the second semiconductor device and biases the body of the one or more second semiconductor devices from the second output bias voltage; the second output bias voltage compensating for the process, voltage and temperature variations, wherein the one or more first semiconductor devices comprise one or more NMOS devices and the one or more second semiconductor devices comprises a one or more PMOS devices, and wherein the first output bias voltage is provided to the second bias circuit and the second output bias voltage is provided to the first bias circuit to increase sensitivity to process, voltage and temperature variations.

* * * * *